US006991226B2

(12) United States Patent
Kimura et al.

(10) Patent No.: US 6,991,226 B2
(45) Date of Patent: Jan. 31, 2006

(54) SHEET DISCHARGE DEVICE WITH SHEET SIZE REFERENCE MEMBERS

(75) Inventors: Hideki Kimura, Saitama (JP); Hiroshi Kawamoto, Hasuda (JP); Kazuhisa Mochizuki, Yamanashi-ken (JP)

(73) Assignees: Fuji Xerox Co., Ltd., Tokyo (JP); Nisca Corporation, Yamanashi-ken (JP)

( * ) Notice: Subject to any disclaimer, the term of this patent is extended or adjusted under 35 U.S.C. 154(b) by 220 days.

(21) Appl. No.: 10/265,431

(22) Filed: Oct. 7, 2002

(65) Prior Publication Data

US 2003/0071412 A1 Apr. 17, 2003

(30) Foreign Application Priority Data

Oct. 15, 2001 (JP) ..... 2001-317291
Oct. 15, 2001 (JP) ..... 2001-317353
Oct. 15, 2001 (JP) ..... 2001-317359

(51) Int. Cl.
*B65H 37/04* (2006.01)

(52) U.S. Cl. ..... 270/58.09; 270/58.08; 270/58.12; 399/410

(58) Field of Classification Search ..... 270/58.09, 270/58.08, 58.11, 58.12, 58.17; 399/410; 227/100

See application file for complete search history.

(56) References Cited

U.S. PATENT DOCUMENTS 4,073,391 A * 2/1978 O'Brien et al. ..... 414/789
4,248,413 A * 2/1981 Fox ..... 270/58.17
4,371,155 A * 2/1983 Astero et al. ..... 270/58.17
4,925,172 A * 5/1990 Christy et al. ..... 270/58.12
4,946,153 A * 8/1990 Kinoshita et al. ..... 270/58.17

FOREIGN PATENT DOCUMENTS

| | | |
|---|---|---|
| JP | 54-476590 | 4/1979 |
| JP | 2-276691 | 11/1990 |
| JP | 7-61693 | 3/1995 |
| JP | 10-109809 | 4/1998 |
| JP | 10181987 A * | 7/1998 |
| JP | 11-139661 | 5/1999 |
| JP | 2000-289921 | 10/2000 |

* cited by examiner

*Primary Examiner*—Patrick Mackey
(74) *Attorney, Agent, or Firm*—Manabu Kanesaka

(57) ABSTRACT

A sheet discharge device includes a housing for housing sheets discharged from an image forming apparatus. A matching reference device includes a plurality of reference members different in matching reference positions for arranging one end of the sheet in the housing. A matching device moves the sheet to the matching reference device to arrange the one end of the sheet.

17 Claims, 11 Drawing Sheets

SHEET DISCHARGE DEVICE WITH SHEET SIZE REFERENCE MEMBERS

BACKGROUND OF THE INVENTION

The present invention relates to a sheet discharge device for carrying out treatments such as accumulating a plurality of sheets discharged from an image forming apparatus such as a copying device or a printer to match them, and stapling (staple) a bundle of sheets thus matched, and an image forming apparatus provided with such a sheet discharge device as described.

The image forming apparatus receives image data to be printed from a data treatment device, for example, such as an image reading device, a facsimile device, or a computer, to form a printed image on the sheet on the basis thereof.

The sheet discharge device receives a sheet after image formation from the image forming apparatus to discharge it onto a sheet discharge tray. However, in case where a plurality of sheets after image formation is present, ends of a bundle of sheets are matched; or the ends of a bundle of sheets are subjected to stapling as necessary; and as the case may be, discharge such as boring a punch hole is carried out. The bundle of sheets applied with such a discharge as described is finally stacked sequentially on the accumulation tray, and taken out by an operator.

In the sheet discharge device as described above, corresponding to the fact that the image forming apparatus is able to handle sheets of various kinds of sizes, it is necessary to carry out post-treatment of sheets of various kinds of sizes similarly to the above.

Corresponding thereto, the sheet discharge device is also to handle sheets of various kinds. A matching reference position of a sheet bundle is normally adjusted to one end side (hereinafter referred to as ⌈reference side⌋) perpendicular to the sheet discharge direction of a sheet discharge outlet to a stack tray. Accordingly, in the image forming apparatus, an image formed sheet is delivered at a position along the reference side to the sheet discharge device.

Therefore, the position of the staple means in the sheet discharge device is naturally arranged at a position on the reference side in the treating tray for carrying out the post-treatment such as matching of a sheet thereon, and the pressing means for pressing the other end of the sheet for adjusting one end of the sheet to be matched is to be arranged on the opposite side of the reference side in the treating tray. And, the matching reference of the sheet bundle is normally set to a fixed position at one place, and therefore, a matching reference portion for controlling the matching reference is provided on the reference side of the treating tray.

Incidentally, in the image forming apparatus and the sheet conveying mechanism in the sheet discharge device, the sheet is normally conveyed in the state that the sheet is nipped by the upper and lower paired rollers arranged at two places. It is desired that the paired rollers at two places are arranged at equal intervals from the center of the sheet. This is because of the fact that when the two paired rollers are at a position extremely different from the center, the conveying direction of the sheet becomes unstable, or the sheet moves obliquely to raise the dangerousness of jamming. However, the image forming apparatus and the sheet discharge device handle sheets of various sizes, and the sheets of various sizes are conveyed and discharged close to the reference side of one end of the device. Therefore, a sheet of the size smaller than that in a prescribed lateral width direction is nipped in the state of being offset greatly from the center of the position at which the paired rollers at two places, or nipping by one paired rollers on the side opposite the reference side becomes disengaged.

Therefore, for example, Japanese Patent Laid-Open No. 276691/1990 (a first prior art) discloses an image forming post-treatment device in which a pair of jogger fences (pressing means) carries out matching such that a sheet is moved close to the central portion of the device from both sides of the device.

Further, in the sheet post-treatment device described in Japanese Patent Laid-Open No. 109809/1998 (a second prior art), as shown in FIG. 11, a side fence 408 for determining a matching reference 408 and a jogger fence 402 corresponding to the pressing means of the present application are made to be independent by an individual driving portion, and to be movable according to the size of copy sheets, and a stapler 400 is moved integral with the side fence 408. Because of this, in the second prior art, the jogger fence 402 and the side fence 408 move along a guide shaft 417 secured perpendicular to the sheet discharge direction to a staple tray 401. The jogger fence 402 is moved through a timing belt 415 by a drive stepping motor 414, and the side fence 408 is moved by the drive stepping motor 411 and a timing belt 412. And, when a copy sheet is conveyed to a staple unit and a rear end of the copy sheet is received in a staple tray, the jogger fence 402 causes the end surface of the copy sheet to move in a direction of the side fence 408 to match it.

However, the post-treatment devices according to these prior arts are very complicated in mechanism, and even the device of the second prior art which is in the form of simplifying the first prior art, a mechanism for actuating the side fence 408 and the stapler 400 for controlling the matching reference and a mechanism for actuating the jogger fence 402 for moving a sheet to the side fence 408 separately therefrom are very complicated, making it difficult to achieve reduction in cost and miniaturization of the device size.

Further, since the side fence 408 and the stapler 400 move integrally, a stapling position applied to a sheet bundle is stabilized but a matching position moves as the stapler moves. The two operating mechanisms are complicated, and a long-period stability of the matching position is not obtained due to the looseness or slipping of the timing belts 411, 414 or the like, thus posing a problem in matching property.

Further, in a space where the stapler 400 moves, since no means for supporting a sheet is provided, sheets drop into the space, thus giving rise to a problem that accurate matching treatment fails to perform.

It is therefore an object of the present invention to provide a sheet discharge device and an image forming apparatus which solves the above-described problem in the sheet discharge device of the type which enables handling of sheets of various sizes by the provision of a plurality of matching reference positions, and which makes enabling a long-period stabilization of the matching performance.

SUMMARY OF THE INVENTION

For achieving the aforementioned object, according to the present invention, there is provided a sheet discharge device, comprising: housing means for housing sheets discharged from an image forming apparatus; matching reference means comprising a plurality of reference members different in matching reference positions for arranging one end of the sheet on the housing means; and matching means for moving a sheet to the matching reference means to arrange one end of the sheet.

Thereby, since one matching reference member moves to a plurality of reference positions, a sheet can be matched at an accurate reference position as compared with the conventional device in which a stop position is displaced and accurate matching cannot be carried out.

For achieving the aforementioned object, the sheet discharge device according to the present invention further comprises post-treatment means moving to a post-treatment position corresponding to a matching reference position of the matching reference means to apply a prescribed post-treatment to the matched sheet; and a moving route for the post-treatment means to move the post-treatment position.

Thereby, since one matching reference member moves to a plurality of reference positions, a sheet can be matched at an accurate reference position as compared with the conventional device in which a stop position is displaced and accurate matching cannot be carried out, and further, the sheet matched to the accurate position can be placed to an accurate position and a predetermined post-treatment can be applied.

For achieving the aforementioned object, the sheet discharge device according to the present invention further comprises support means for supporting a sheet within the moving route.

Thereby, it is possible to prevent the sheet from dripping in and being caught by the moving route in which the post-treatment means moves to produce disturbance of the matching state of the sheet, giving rise to the jam.

For achieving the aforementioned object, the sheet discharge device according to the present invention provides an arrangement wherein the moving route is formed from a notch portion provided in a sheet place portion of the housing means.

Thereby, miniaturization of the device can be planned as compared with the arrangement in which the moving route in which the post-treatment means moves is provided externally of the sheet housing portion.

For achieving the aforementioned object, the sheet discharge device according to the present invention provides an arrangement wherein the support means is changed in a region for supporting a sheet according to a matching reference position of the matching reference means.

Thereby, since the support means is not so designed that only the portion required for the sheet to be supported due to the change in the matching reference position is buried to always burry the whole moving route, the support means itself can be constituted in compact.

For achieving the aforementioned object, the sheet discharge device according to the present invention further comprises a lower support portion which moves following the post-treatment means to move into a portion below the sheet place portion, an upper support portion for supporting a sheet at nearly the same height as the sheet place portion, and an inclined support portion for connecting said lower support portion and the upper support portion.

Thereby, since the lower support portion moves into the sheet place portion, a region for supporting a sheet by the support means can be changed, and even where an end of the sheet is fallen into a difference in height between the lower support portion and the upper support portion, it is guided along the inclined portion and guided to the upper support portion at nearly the same height as the sheet place portion.

For achieving the aforementioned object, the sheet discharge device according to the present invention provides an arrangement wherein the support means is secured to the post-treatment means.

Thereby, the support means can be moved together with the post-treatment means, and moving drive means need not be provided separately from the post-treatment means, thus enabling to make the constitution compact.

For achieving the aforementioned object, the sheet discharge device according to the present invention provides an arrangement wherein the support means has a control member for arranging the other end of a sheet adjacent to one end of a sheet arranged by the matching reference means.

Thereby, the support means moves adjusting to the matching reference, and the control means for arranging the other end adjacent to one end of the sheet to be matched by the matching reference means moves also. Therefore, even if the matching reference is changed, the other end of the sheet can be controlled adequately and arranged.

For achieving the aforementioned object, the sheet discharge device according to the present invention provides an arrangement wherein the support means has weight means for preventing a curl of a sheet.

Thereby, the support means moves adjusting to the matching reference, and the weight means moves also. Therefore, even if the matching reference is changed, the curl of the sheet is suppressed adequately, and the sheet can be subjected to post-treatment while maintaining an adequate attitude by tile post-treatment device.

For achieving the aforementioned object, the sheet discharge device according to the present invention further comprises support means for movably supporting the plurality of reference members except at least a reference member at a reference position farthest from the matching means between an engaging position engaged with one end of the sheet on the housing means and a withdrawal position withdrawn from the engaging position; and moving means for selectively moving the reference member support means so as to differentiate the reference position according to a discharge reference when a sheet is discharged and the sheet size.

Thereby, accurate matching and post-treatment can be carried out without displacement of the reference position itself; for example, for a sheet of smaller size in the direction in which the sheet is matched, a reference member close to the matching means is used to enable making the distance which moves when the sheet is matched short; and the time required for matching can be shortened to enable reduction in dangerousness of the jam at the time of matching.

For achieving the aforementioned object, the sheet discharge device according to the present invention further comprises common driving means for moving said post-treatment means to actuate said moving means.

Thereby, movement of the reference member between the engaging position and the withdrawal position and movement of the post-treatment means can be operated by one and the same driving means, thus enabling planning further miniaturization of the device and lower cost.

For achieving the aforementioned object, the sheet discharge device according to the present invention provides an arrangement wherein the moving means is formed from a friction member which moves with the post-treatment means, and a contact member which engages said friction member according to movement of the post-treatment means to move the reference member to the engaging position, and disengages from the friction member to move said reference member to a withdrawal position.

Thereby, the reference member can be moved between the engaging position and the withdrawal position by the movement of the post-treatment means, and further miniaturization of the device and the lower cost can be planned.

For achieving the aforementioned object, the sheet discharge device according to the present invention comprises conveying means for receiving a sheet discharged from an image forming apparatus to convey the sheet to housing means; and common driving means for driving the conveying means to convey a sheet, and moving post-treatment means to a post-treatment position.

Thereby, sheet conveyance by the conveying means and movement of the post-treatment means can be operated by one and the same driving means, and further miniaturization of the device and the lower cost can be planned.

For achieving the aforementioned object, the sheet discharge device according to the present invention provides an arrangement wherein one of normal and reverse driving forces of the driving means is used for sheet conveyance by the conveying means, and the other is used for movement of the post-treatment means.

Thereby, sheet conveyance by the conveying means and movement of the post-treatment means can be operated by normal and reverse driving of one and the same driving means, and further miniaturization of the device and the lower cost can be planned.

For achieving the aforementioned object, an image forming apparatus according to the present invention comprises: an image forming portion for forming an image on a sheet; housing means for housing a sheet discharged from the image forming portion; matching reference means comprising a plurality of reference members different in reference position for arranging one end of the sheet on the housing means; matching means for moving a sheet to the matching reference means to arrange one end of the sheet; transmission means for transmitting a signal representative of at least a sheet size of a sheet or a discharge reference at which a sheet is discharged; reference member support means for movably supporting at least a plurality of reference members except reference members at a reference position farthest from said matching means between an engaging position engaging one end of the sheet on the housing means and a withdrawal position withdrawn from the engaging position); moving means for moving the reference member supported by the reference member support means between said engaging position and the withdrawal position; and control means for controlling the moving means so that said reference member is selectively moved to the withdrawal position according to a signal from said transmission means to differentiate the reference position.

Thereby, for example, for a sheet of smaller size in the direction in which the sheet is matched, a reference member close to the matching means is used to enable reducing the distance moved when the sheet is matched, and the time required for matching can be shortened to reduce the dangerousness of the jam of the sheet at the time of matching.

For achieving the aforementioned object, the image forming apparatus according to the present invention comprises post-treatment means which moves to a post-treatment position corresponding to the reference position to apply a prescribed post-treatment to the sheet matched.

Thereby, prescribed post-treatment can be applied to an accurate position relative to the sheet matched with accuracy.

For achieving the aforementioned object, a sheet discharge device according to the present invention comprises housing means for housing a sheet discharged from an image forming apparatus; matching reference means to be a reference for arranging a sheet on said housing means; matching reference position changing means for moving the matching reference means to change a matching reference position for arranging the sheet; matching means for moving a sheet to said matching reference means to arrange the sheet; post-treatment means which moves to a post-treatment position corresponding to the matching reference position of the matching reference means to apply a prescribed post-treatment to the matched sheet; a moving route for said post-treatment means to move to the post-treatment position; and support means for supporting a sheet within the moving route.

Thereby, it is possible to prevent that the sheet drops into and is caught by the moving route in which the post-treatment means moves, giving rise to disturbance of the matching state of the sheet or to give rise to jamming.

For achieving the aforementioned object, the sheet discharge device according to the present invention comprises common driving means for actuating the post-treatment means and the matching reference means.

Thereby, movement of the post-treatment means and the matching reference means can be actuated by one and the same driving means, and further miniaturization of the device and lower cost can be planned.

For achieving the aforementioned object, the sheet discharge device according to the present invention comprises conveying means for receiving a sheet discharged from an image forming apparatus to convey the sheet to said housing means; and common driving means for driving said conveying means to convey a sheet, and moving said post-treatment means to said post-treatment position.

Thereby, conveyance of a sheet by the conveying means and movement of the post-treatment means can be actuated by one and the same driving means, and further miniaturization of the device and lower cost can be planned.

For achieving the aforementioned object, the sheet discharge device according to the present invention provides an arrangement wherein one of normal and reverse driving forces of said driving means is used for sheet conveyance by the conveying means, and the other is used for movement of the post-treatment means.

Thereby, conveyance of a sheet by the conveying means and movement of the post-treatment means can be actuated by one and the same driving means, and further miniaturization of the device and lower cost can be planned.

For achieving the aforementioned object, an image forming apparatus according to the present invention comprises: an image forming portion for forming an image on a sheet; housing means for housing a sheet discharged from the image forming portion; matching reference means comprising a plurality of reference members different in reference position for arranging one end of the sheet on the housing means; matching means for moving a sheet to matching reference means to arrange one end of the sheet; transmission means for transmitting a signal representative of at least a sheet size of a sheet or a discharge reference at which a sheet is discharged; and control means for controlling the matching reference position changing means so that the reference position is differentiated according to a signal from the transmission means Thereby, where a sheet is discharged with the central part, left end and right end thereof as a reference, or where even the same discharge reference, the sheet size itself is different, one end on the matching reference means side of the sheet to be discharge is different. With respect to one end which is different in position as described, a matching reference position is differentiated whereby the dangerousness of jamming based on the shortening of the distance in which the sheet moves to the matching reference position can be lowered, and the time required for matching can be shortened.

For achieving the aforementioned object, the image forming apparatus according to the present invention comprises post-treatment means which moves to a post-treatment position corresponding to the reference position to apply a prescribed post-treatment to the sheet matched.

Thereby, predetermined post-treatment can be applied at an accurate position to the sheet matched to an accurate position.

DESCRIPTION OF THE PREFERRED EMBODIMENTS

Embodiments of a sheet discharge device of the present invention and an image forming apparatus provided with the sheet discharge device will be described in detail hereinafter with reference to the drawings.

Figure 1:
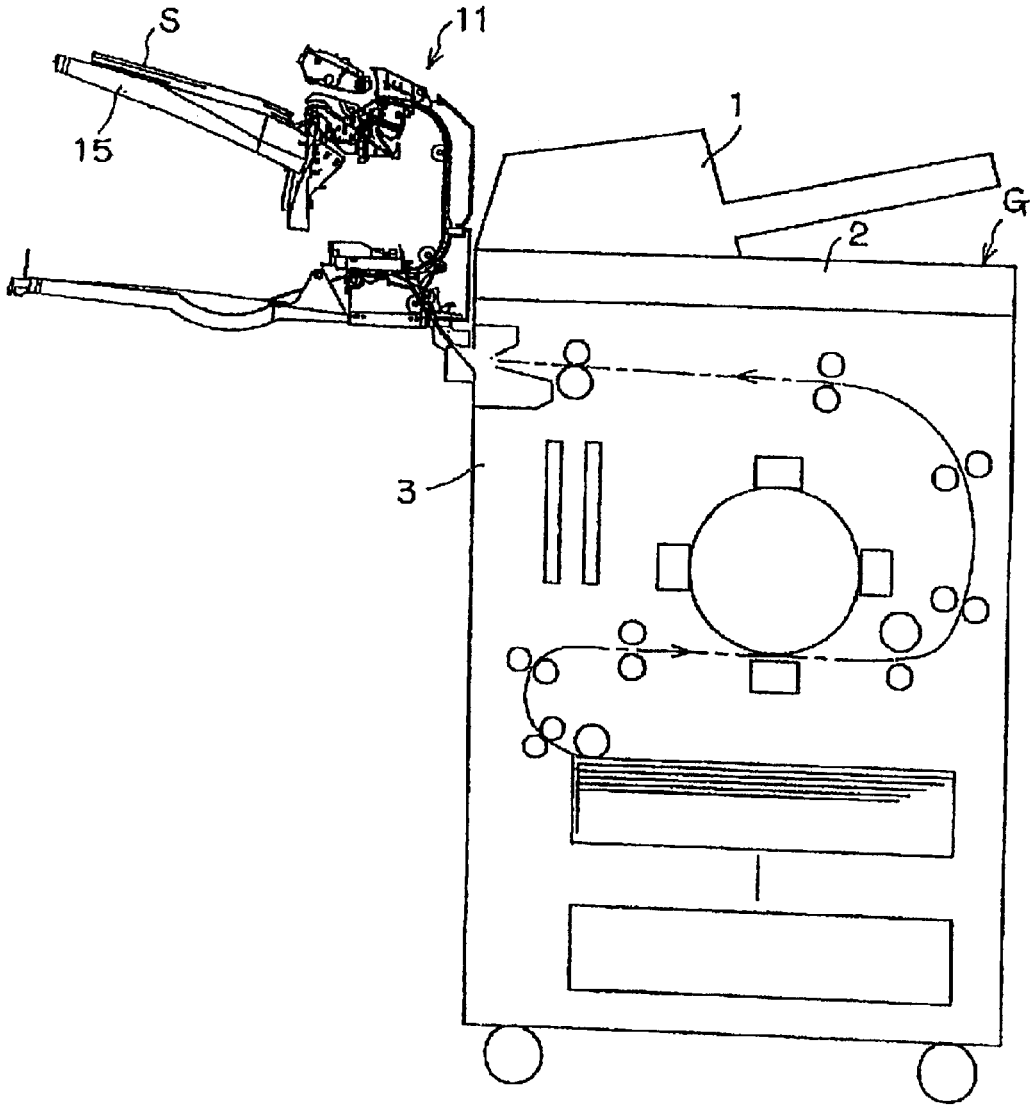
FIG. 1 is a schematic view showing the entire constitution according to an embodiment of the present invention.

FIG. 1 is a schematic view showing the entire constitution according to an embodiment of the present invention.

In FIG. 1, there is constituted by an image forming apparatus G such as a copying machine, a printer or the like, and a sheet discharge device 11 as a sheet discharge device. The sheet discharge device 11 has the construction that can be detachably mounted on the image forming apparatus G.

The image forming apparatus G shown in FIG. 1 shows the constitution of main parts of a known copying machine or a printer, and is provided with a scanner (an image read device) 2 below an automatic original feeder (ADF) 1. An image producing portion (a printer engine) is arranged below the scanner 2.

Figure 2:
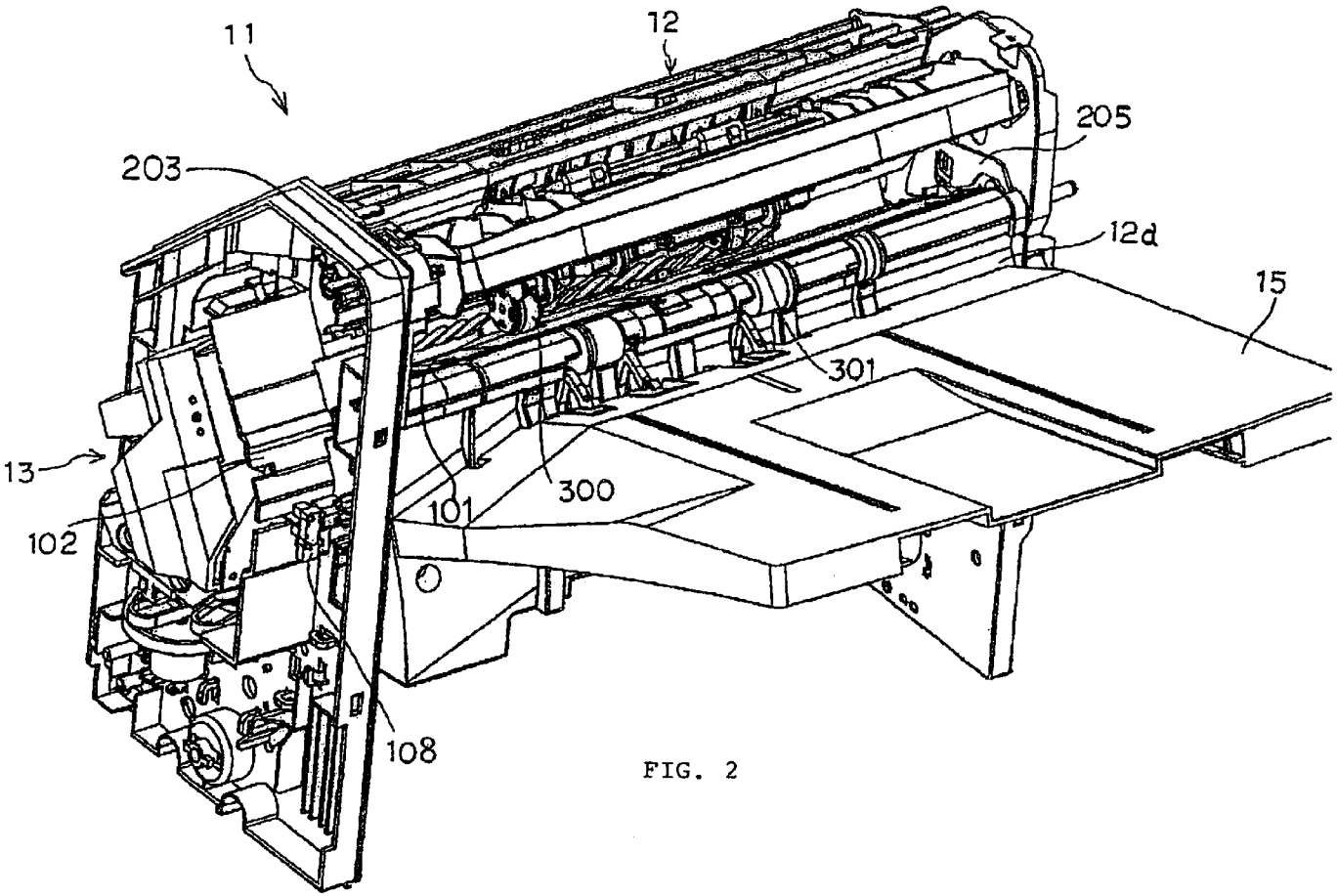
FIG. 2 is a perspective view showing the external appearance constitution of main parts of a sheet discharge device shown in FIG. 1.
Figure 3:
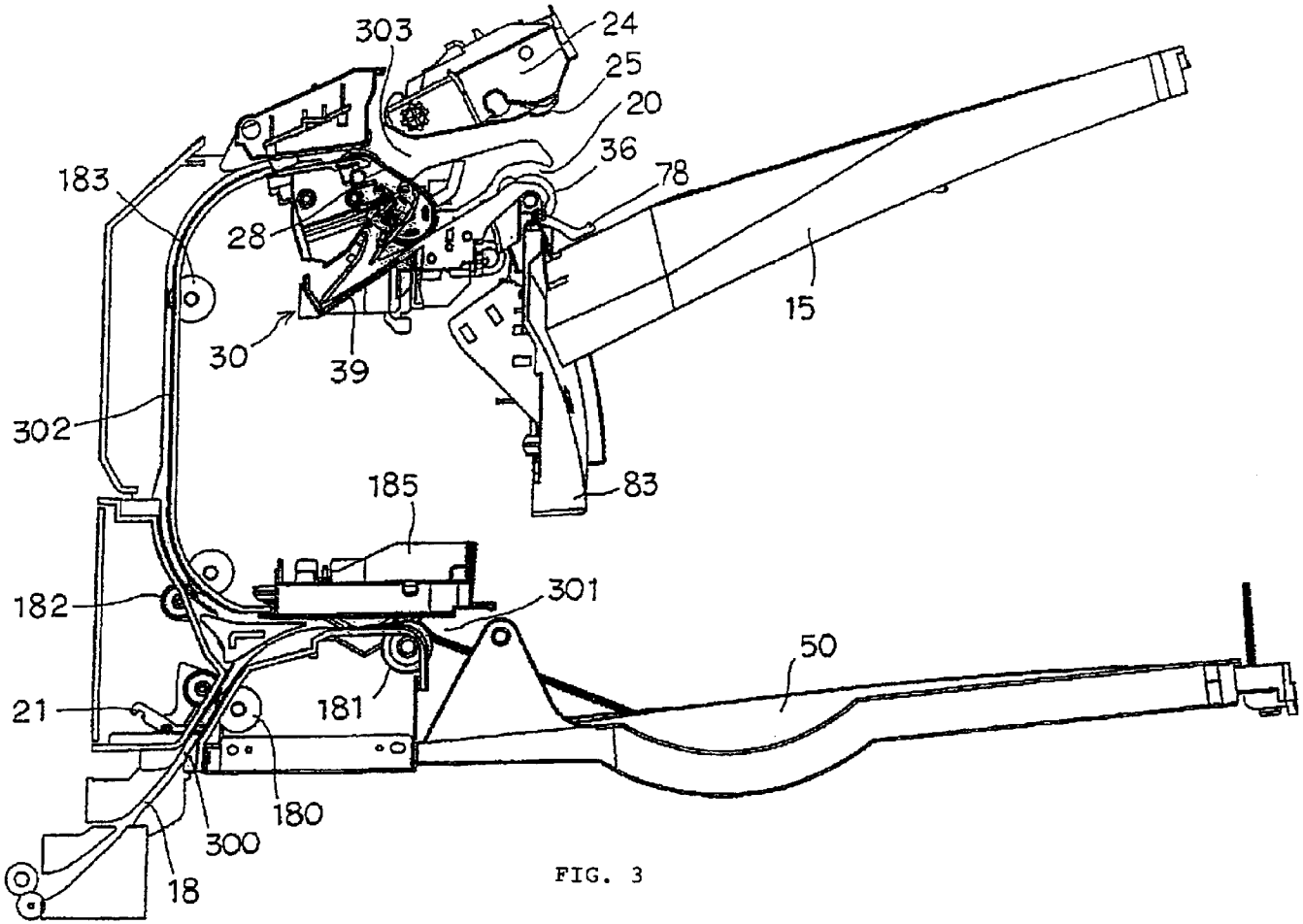
FIG. 3 is a side view showing the internal appearance constitution of main parts of a sheet discharge device shown in FIG. 1.

FIG. 2 is a perspective view showing the external appearance constitution of main parts of the sheet discharge device 11 in the state that a cover is removed, and FIG. 3 is a perspective view showing the internal appearance constitution of main parts of the sheet discharge device 11.

In FIGS. 1 and 2, the sheet discharge device 11 is provided with a body device 12, a staple unit 13 for stapling a sheet bundle arranged on one side frame of the body device 12, and a driving force transmission mechanism 14 arranged on the other side frame of the body device 12.

The present device is provided with a receiving inlet 18 to which a sheet formed with an image discharged from the image forming device G is supplied, an inversion tray 50 for inverting a sheet S, a discharge outlet 20 formed on the surface on the side opposite the receiving inlet 18, and an accumulation tray 15 for accumulating the sheet S discharged from the discharge outlet 20.

An inversion tray 50 for inverting the sheet S is provided at a lower position of the accumulation tray 15. The accumulation tray 15 is provided above the sheet discharge device 11, and a lower portion of the accumulation tray is a vacant space. The inversion tray 50 is arranged in the vacant space to thereby realize the space saving on the side of the image forming apparatus G, enabling miniaturization of the sheet discharge device 11.

It is noted that a switch-back route for inverting both sides of a sheet and inversion means need not be provided depending on the image forming apparatus G, but in the present embodiment, supposing that an inversion function is provided, a description will be made hereinafter.

The staple unit 13 is to staple an end of a sheet S bundle, and in place thereof, other post-treatment means such as a boring unit for boring a punch hole or a pasting unit for applying paste to the end of the sheet S bundle may be arranged. Here, a description will be made supposing that staple means is provided.

The body device 12 is internally provided with a first conveying route 300 for introducing a sheet S from the receiving inlet 18 to guide it to the inversion tray 50, a second conveying route 302 as inversion means for inverting a sheet from the inversion tray 50 to the accumulation tray 15 through the discharge outlet 20 to discharge it, and a third conveying route 303 different in level from the second conveying route 302 for conveying a sheet S into the treating tray 39 as housing means for switching back the conveying direction to temporarily house the sheet S.

In the treating tray 39, stapling by way of the staple unit 13 is carried out, and matching for matching an end surface of a bundle of sheets S is carried out, for example, by a pressing and driving member (not shown).

Next, with respect to the present device, there will be explained a flow of receiving a sheet from an image forming apparatus, accumulating and matching it, and stapling.

Sheets S are switch-back conveyed along the second and third conveying routes 303, and a plurality of sheets is placed on a treating tray 39 for matching. After stapling has been carried out by the staple unit 13, a bundle of sheets S is discharged to the accumulation tray 15.

The first conveying route has an inlet sensor 21 for detecting an end of a sheet and an inlet roller 180, and extends to a switch-back conveying route 301. The switch-back conveying route 301 has a switch-back roller 181 and an inversion sensor 185 for detecting an end of a sheet, and extends to the inversion tray 50.

The second conveying route 302 has an endless conveying belt 38 for conveying a sheet S to the third conveying route 303. A treating tray unit 30 is provided downward of the endless conveying belt 28. The treating tray unit 30 is provided to temporarily place the sheets S thereon in order that endless conveying belt 28 rotates to draw the sheets S sequentially, and stapling is carried out by the staple unit 3 for every bundle of the prescribed number of sheets. Further, a fixed matching reference member 203 is formed on one side of the treating tray 39 opposite a pressing means 205 as a matching means.

The second conveying route 302 curves from the switch-back conveying route 301 and extends to a conveying roller 182, and the second conveying route 302 of a conveying roller 183 is provided to be stood upright nearly vertically from the conveying roller 182, and curves form the conveying roller 183 and directed at the discharge outlet 20.

Further, a turning unit 24 which rotates vertically about a paddle driving roller shaft is provided upward of the second conveying route 302. The turning unit 24 moves to a lower position when a bundle of sheets S within the treating tray unit 30 is discharged to the accumulation tray 15, and moves to an upper position where the sheets S are guided to the third conveying route 303 to the treating tray unit 30.

Further, a driven discharge roller (a bundle discharge roller) 25 is provided within the turning unit 24. The driven discharge roller 25 is provided in order to discharge sheets S or a bundle of sheets S from the discharge outlet 20 to the accumulation tray 15. A discharge roller 36 is arranged, opposing to the driven discharge roller 25, in the discharge outlet 20.

A sheet knocking member 12*a* for controlling an end edge of a sheet S accumulated on the accumulation tray 15 is constituted integral with a front frame of the body device 12 below the discharge roller 36. There is provided a sheet keep lever 78 which appears and disappears from an upper position of the sheet knocking member 12*a* close to the discharge roller 36 of the sheet knocking member 12*a* towards the accumulation tray 15. The sheet keep lever 78 moves so as to project towards the accumulation tray 15 at the time when the sheets S or a bundle of sheets S are discharged by the discharge roller 36 and the driven discharge roller 25.

Now, the constitution of the staple unit 13 and the treating tray 39 in the sheet discharge device 11 according to the present invention will be described.

As described above, the sheets S conveyed from the first conveying route 301 are placed on the treating ray 30 via the third conveying route 303 by the endless conveying belt 28. For sizes of the sheets S, there is a plurality of sizes, and discharge references at which tile sheets are discharged also include a plurality of discharge references such as a center reference, a front one-side reference, and a rear-side reference. Matching is carried out at a matching reference position corresponding to the sheet different in sizes or discharge reference, and a prescribed position of the sheet S is stapled by a staple moved to the post-treatment position according to the matching reference position.

In matching the sheets S, the sheets S are pressed, for matching, by the pressing means 205 for moving it in a direction of matching reference in order to adjust the end of the sheet on the treating tray to the matching reference in one direction going through in a direction of discharging the sheet.

In the sheet discharge device 11 of the present embodiment, a matching member 101 as matching and reference means capable of being elevated adjusting to the size of sheets S is provided on the treating tray 39, and the staple unit 13 moves to left and right as viewed from the front of the body device 12 adjusting the size of the sheets S. Further, a slide tray 202 as a part of the treating tray is constituted integral with the staple unit 13 and cooperatively operated. In the form of the present embodiment, the matching and reference member movable between an engaging position in engagement with one end of the sheet on the housing means and a withdrawal position withdrawn from the engaging position is to be one of the matching member 101, but it is needless to say that the matching and reference position may be changed selectively, by the similar constitution, according to the sheet size and the sheet discharge reference handled, providing it at plural locations different in the matching and reference position.

Further, in the present embodiment, the matching and reference member at a reference position farthest from the pressing means 205 as the matching means and formed On one side of the treating tray 39 is fixedly provided, but it may be provided movably between the engaging position in engagement with the one end of the sheet on the housing means and the withdrawal position withdrawn from the engaging position.

Now, the slide tray 202 provided integral with the staple unit 13 will be described in detail.

The treating tray 39 is formed with a notch 201 for securing a moving space of the staple unit 13. When the notch is not present, the moved staple unit 13 staples the treating tray 39. When the notch is present, the sheet surface cannot be maintained in a stabilized manner. In the present embodiment, the staple unit 13 is formed with the slide tray 202 which moves following the staple unit 13 to burry the notch 201 of the treating tray. The staple unit 13 and the slide tray 202 are constituted integrally. In the slide tray 202, as the staple unit 13 moves, the slide tray 202 also moves to burry a portion of the notch 201 of the treating tray 39 to secure a sheet pass surface.

For example, at the time of treating the sheet S of small size such as A5 size, the staple Unit 13 moves toward the matching member 101, but the slide tray 202 provided on the staple unit 13 also moves into the lower surface of the treating tray 39.

The slide tray 202 in the present embodiment functions as support means for preventing a sheet from falling into the notch 201 as a moving route, the constitution of which comprises a lower support portion 202*b* entering the lower surface of the treating tray 39 as the staple moves, an upper support portion 202*a* forming nearly the same plane as the treating tray, and an inclined support portion 202*c* for connecting a portion between the lower support portion 202*b* and the upper support portion 202*a* of the slide tray 202.

The sheet support surface of the slide tray 202 is constituted by support surfaces provided in the lower support portion, the upper support portion and the inclined support portion, respectively, and the end of the sheet S is prevented from being caught at a border between the slide tray 202 and the treating tray 39 by the support surface of the inclined support portion 202*c*. Further, the support surface of the inclined support portion 202*c* also has the effect that when a sheet is conveyed, trouble such as jamming is prevented so that the sheet can be guided positively to the treating portion of the staple unit.

The lower support portion 202*b* of the slide tray 202 assumes the state that drawn out of the lower surface of the treating tray 39 when the sheet on the treating tray 39 is matched in the fixed matching and reference portion (when the sheet of large size is treated), and assumes the state that part thereof is moved into the lower surface of the treating tray 39 when matched by either matching vertically movable matching member 101. In this manner, moving of the staple unit 13 is carried out adjusting to the sheet size, and the notch 201 of the treating tray 39 is buried expansively by the slide tray 202 as the staple unit 13 moves to secure a sheet surface. In this manner, even if the staple unit 13 is moved, the matching movement of the sheet on the treating tray 39 is not impeded.

The treating tray 39 is provided with an end control member 209 for arranging an end in a discharging direction of a sheet, and the slide tray 202 is also provided with a similar control member for controlling an end in a discharging direction of the sheet in cooperation with the end control member. Further, at least one of the slide trays 202 of the treating tray 39 is further provided with a weight 204 for preventing bending-up of a sheet to be matched. The weight moves following the movement of the staple unit 13, and is not displaced from the sheet surface even if the sheet size is changed. Since the weight 204 is set to a position for keeping a sheet by the upper support portion 202*a* of the slide tray 202, the sheet S is not pressed down into a gap heightwise of the upper support portion 202*a* and the lower support portion 202*b* to impede the matching action by the pressing means 205 as matching means as in the case where the sheet is kept by the lower support portion 202*b* of the slide tray 202, but the sheet S can be guided positively to the treating portion of the staple unit 13.

Figure 4:
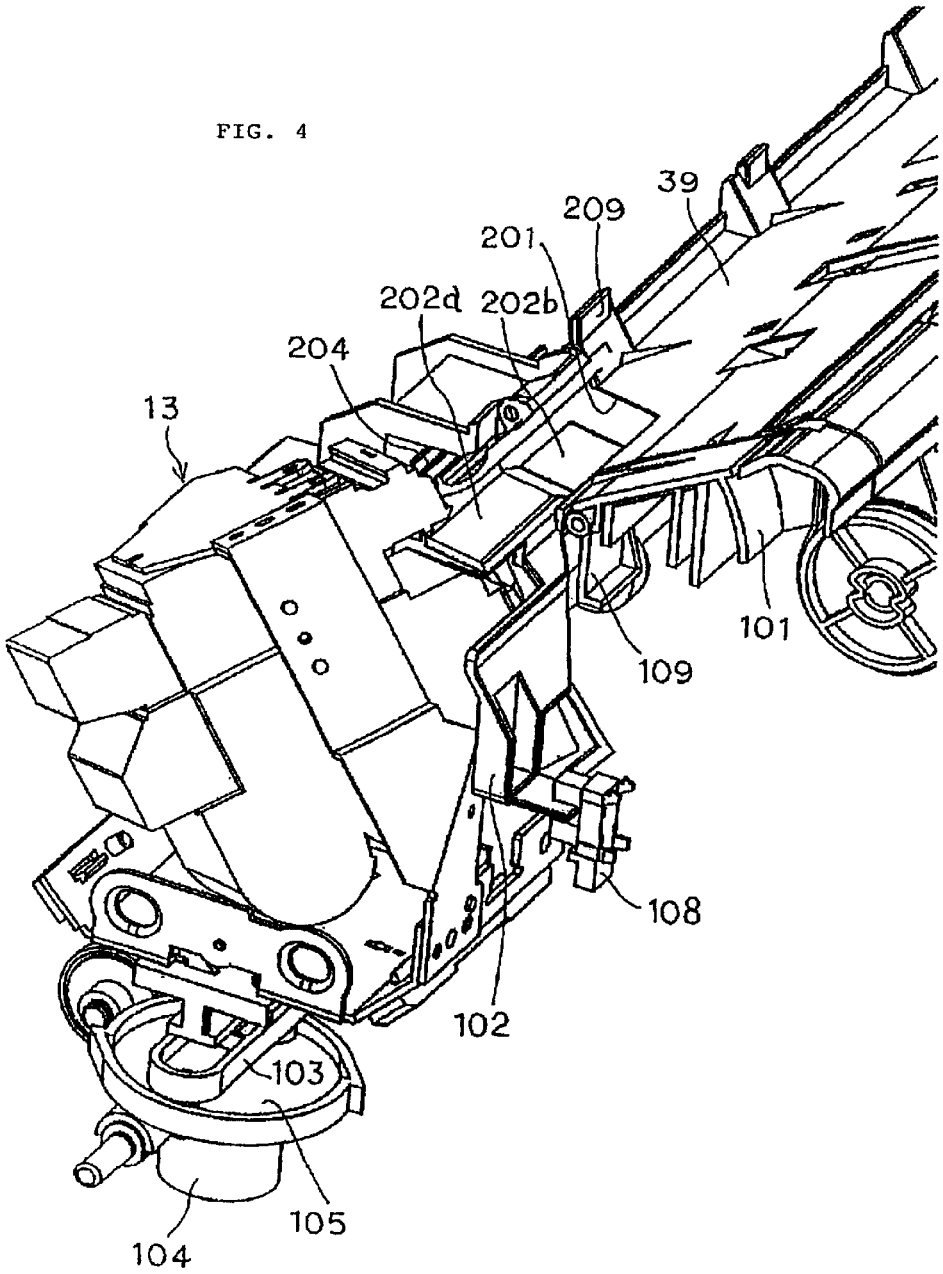
FIG. 4 is a perspective view showing, in an enlarged scale, a portion of a treating tray and a constitutional portion of a staple unit of the present sheet discharge device, further showing the state that a matching member is moved down.
Figure 5:
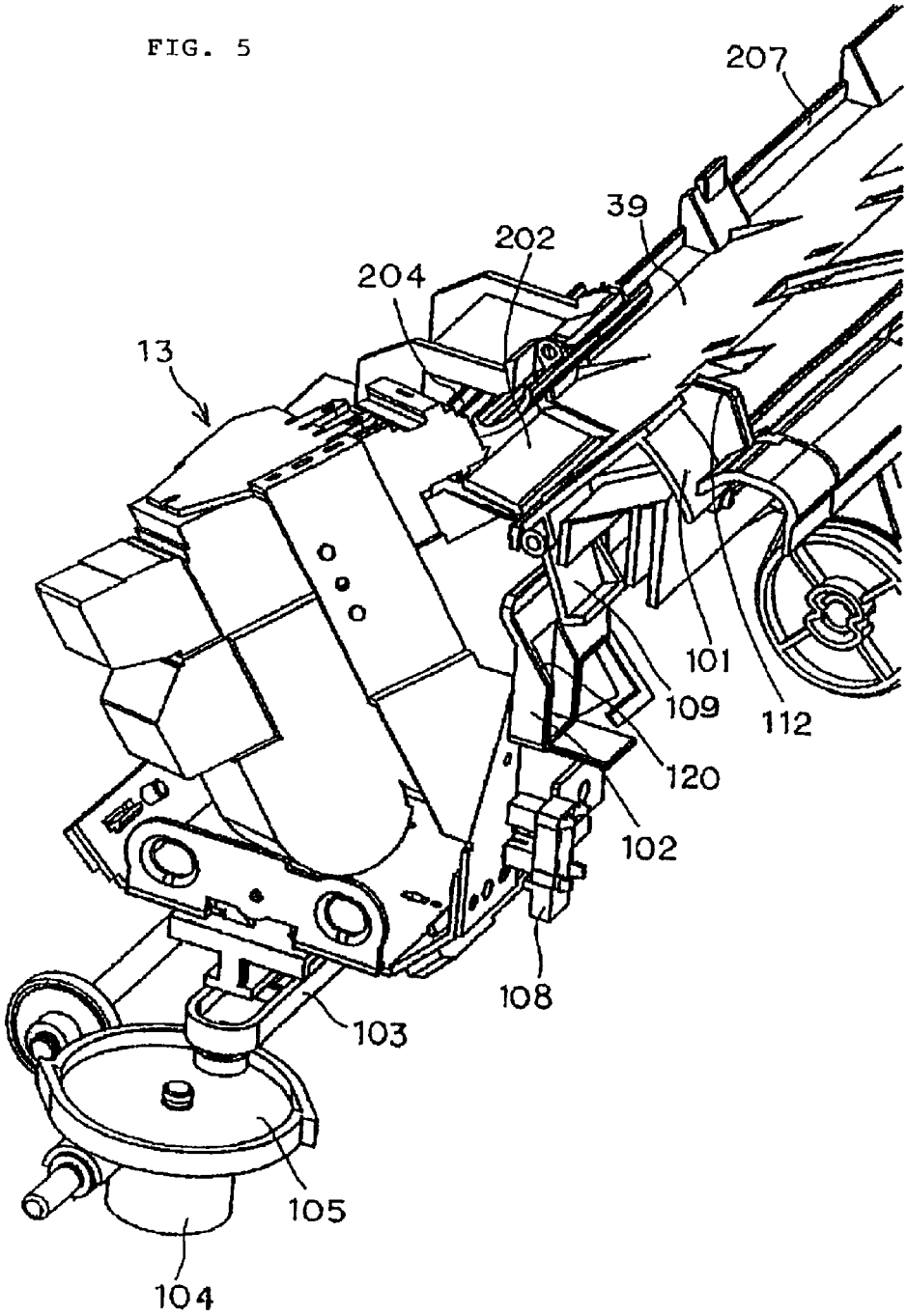
FIG. 5 is a perspective view showing, in an enlarged scale, a portion of a treating tray and a constitutional portion of a staple unit of the present sheet discharge device, further showing the state that a matching member is moved up.

FIGS. 4 and 5 are respectively perspective views showing, in an enlarged scale, a portion of the treating tray 39 and a portion of the staple unit 13 in the sheet discharge device 11.

A request signal for the shift operation (herein, stapling in the shift operation described above), the size of the sheet S, and the operation of the staple unit 13 according to the discharge reference of the sheet S is transferred to the sheet discharge device 11 along with the conveyance of the sheet S from the image forming apparatus G. Switching between the shift operation mode and the straight operation mode is carried out by the signal. When the movement is necessary from judgment of the present stop position of the staple unit 13 and a position requested newly, the staple unit 13 is moved to a position corresponding to the request.

Here, there is shown an example of the sheet S-size judging reference for carrying out the movement of the staple unit 13 and the vertical movement of the matching member 101 according to the size of the sheet S.

The moving directions of the staple unit 13 are set according to the sizes of sheets S.

For example, a group of large sheets is set to a group A, and a group of small sheets is set to a group B.

The sheet sizes of the group A include A3, B4, A4LEF, B5LEF, LD, LTLEF, HACHIBIRAKI (273×392 mm), and 7.25×10.5LEF (Executive).

The sheet sizes of the group B include A4SEF, B5SEF, A5LEF, 8.5×14 (LG), 8.5×13. LTSEF, and STLEF.

In the group A, the staple unit 13 is at a home position, and the matching member 101 is not pushed up.

In the group B, the staple unit 13 is pushed into the body device 12 side, and the matching member 101 is pushed up.

In FIG. 4, the treating tray 39 and the staple unit 13 show the state that sheets S of a group A which is a large size are treated. The matching member 101 moves down, and the tray surface of the treating tray 39 and the tray surface of the matching member 101 are in the same plane. The position of the staple unit 13 is a home position of the staple unit 13. FIG. 5 shows the state that the treating tray 39 and the staple unit 13 treat a small size sheet S. The movable matching member 101 of the treating tray 39 moves and is pushed upward by the pushing-up member 102 provided on the staple unit 13 as the staple unit 13 moves. The moved and pushed up matching member 101 is a matching reference adjusted to the size of a sheet S. The width of the treating tray 39 is narrow adjusting to the sheet.

In FIGS. 4 and 5, a region or an area of a support surface for supporting a sheet on the side tray 202 as support means for supporting a sheet within a moving route of the staple unit 13 is wide so as to extend to the whole notch portion 201 in FIG. 4, and is narrow in FIG. 5 since the lower support portion 202*b* moves into the lower part of the treating tray 202.

Now, a driving force transmission mechanism of the present sheet discharge device 11 will be described in detail.

Figure 10:
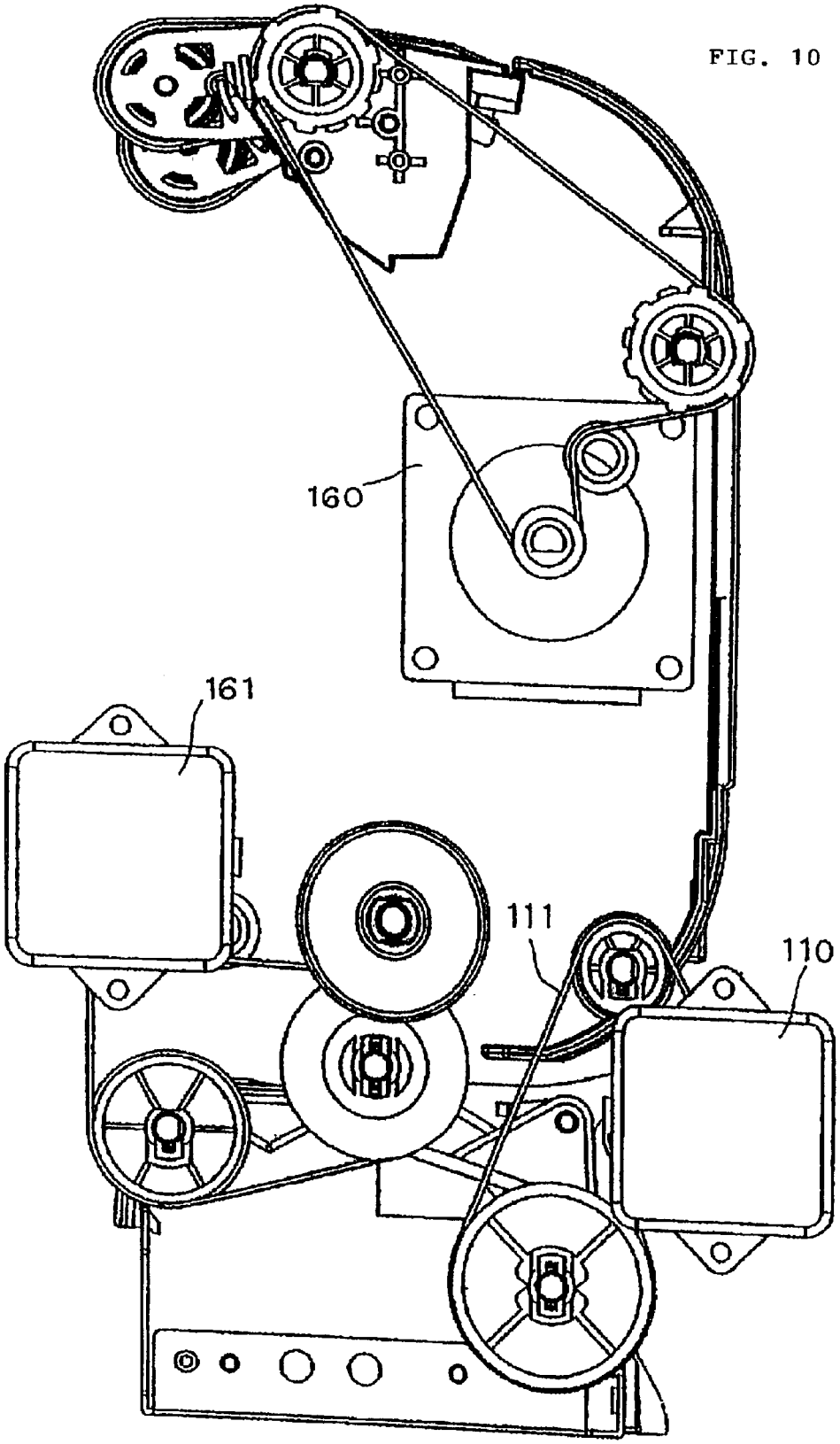
FIG. 10 is an outline view showing a driving mechanism within the present sheet discharge device.
Figure 11:
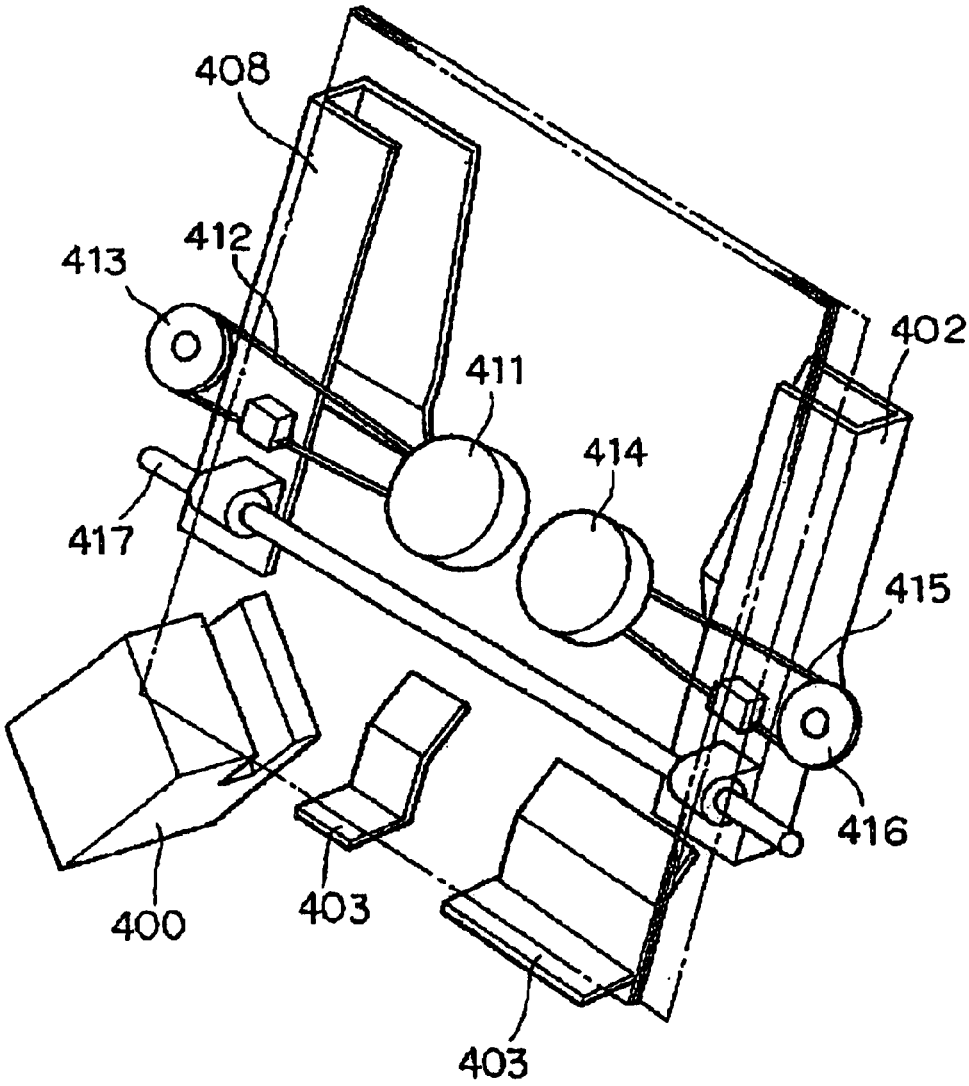
FIG. 11 PRIOR ART
FIG. 11 shows an example of a sheet discharge device according to prior art.

FIG. 10 is a schematic view showing the arrangement of a driving device of the sheet discharge device 11.

The driving device is formed along the sheet conveying passage for discharging after sampling from the sheet receiving inlet 18. The driving device comprises an inlet motor 110, an inversion motor 161, a conveying motor 160, a belt 111 for transmitting the driving force, a rotational gear, a rotational shaft 107, various conveying rollers, the endless conveying belt 28 and the like.

The conveying motor 160 performs the conveying and driving of the second conveying route 302 for inverting and discharging sheets to the accumulation tray 15 passing through the discharge outlet 20 from the inversion tray, and the third conveying route 303 for switching back the conveying direction to convey sheets into the treating tray 39 for temporarily housing the sheets.

The inversion motor 161 is operated so that sheets S are received from the sheet receiving inlet 18 and housed in the inversion tray 50, and after being conveyed by prescribed distance, the sheets are switched back by the reversal driving of the inversion motor 161, and the driving force conveyed from the inversion tray to the conveying passage is supplied through the belt, the roller and the like. By the inversion operation, the sheet S is able to arrange the page order in order of treatment of originals on the treating tray 39.

In the present device, the inlet motor 110 supplies the driving force for carrying out the driving of the inlet roller 180 and the movement of the staple unit 13.

Figure 6:
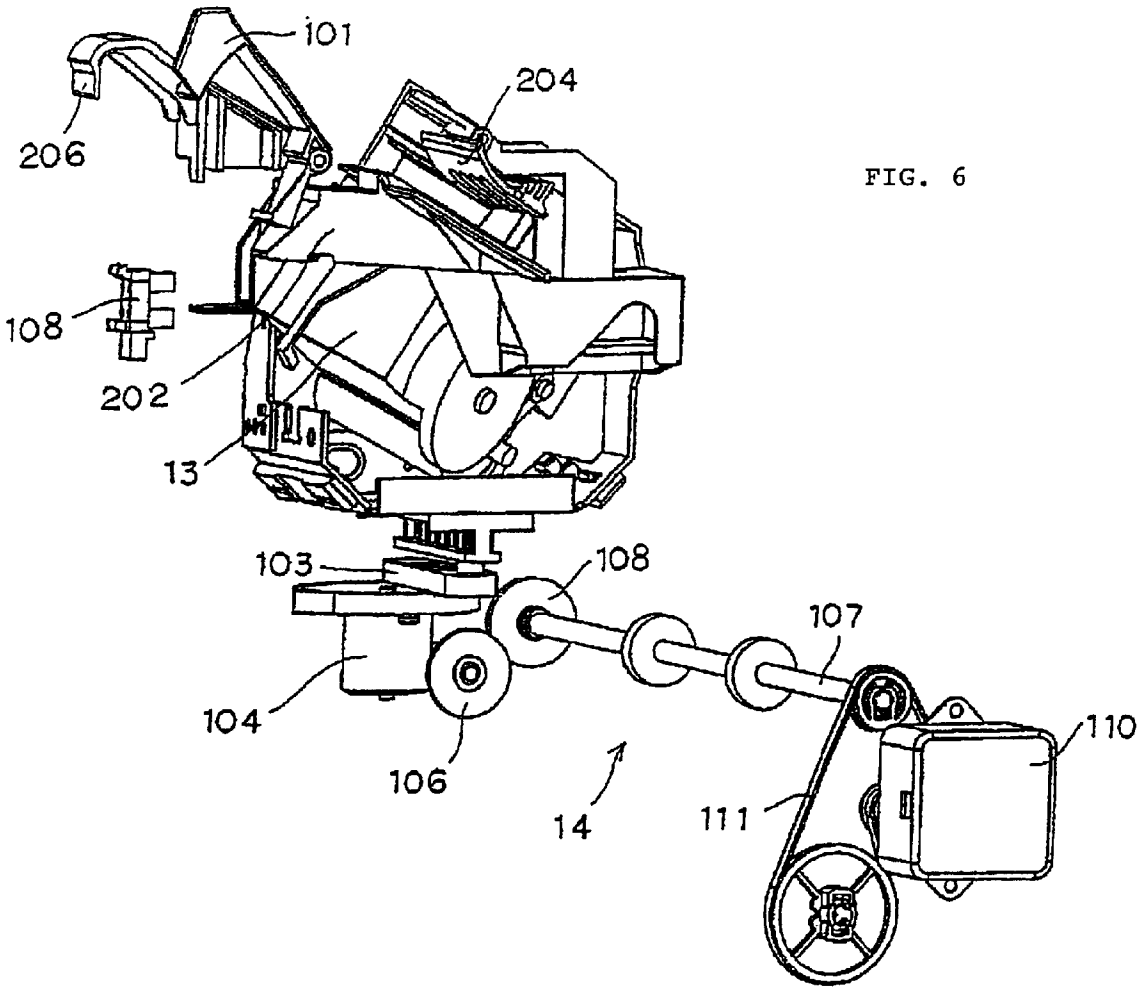
FIG. 6 is an outline view of a driving transmission mechanism for carrying out driving of a conveying roller and movement of a staple unit formed in the present sheet discharge device.

FIG. 6 is a schematic view of the driving force transmission mechanism 14 for carrying out driving of the inlet motor 107 formed on the sheet discharge device 11 and movement of the staple unit 13.

This mechanism is constituted so that when one inlet motor 110 constituting sheet receiving and conveying means is rotated in one direction (normal rotation), the inlet roller 180 is driven, and when rotated in the other direction (reversal rotation), moving of the staple unit 13 is carried out through a staple moving mechanism.

The staple moving mechanism comprises the driving force transmission mechanism 14 for transmitting the driving force of the input motor 110, and a one-way gear 108 as one-way means or clutch means for cutting off the driving force to the staple unit 13 from the driving force transmission mechanism 14 when the inlet motor 110 rotates in one direction (normal rotation) and for transmitting the driving force to the staple unit 13 when the inlet motor 110 rotates in the other direction (reversal rotation).

The staple moving mechanism further comprises driving force conversion means for converting the rotation driving force transmitted through the one-way gear 108 of one-way clutch to linearly reciprocate the staple unit 13.

The driving force conversion means comprises a worm wheel 104 and a rank lever 103 whose one end is connected free to turn to a peripheral edge of the worm wheel 104 and the other end is connected to the staple unit.

The worm wheel 104 is formed with a peripheral wall surrounding the peripheral edge in one surface thereof, and one end of the crank lever is connected free to turn through a rotational member which slidably rotates in contact with the inside of the peripheral wall.

Next, the moving mechanism of the staple unit 13 will be described together with the operation thereof.

The staple unit 13 is normally positioned on the matching reference side which is a staple position (a home position) of a large-size sheet.

A request signal for operation corresponding to a small-size sheet S is transferred from the image forming apparatus S to the sheet discharge device 11. Judgment is made of the present position of the staple unit 12 and a position indicated by the request signal, and when movement is necessary, the movement starts.

The inlet motor 110 starts its reversal rotation. The inlet motor 110 drives, when in normal rotation, the inlet motor 180 to convey the sheet S. Upon the start of reversal driving, the one-way gear 108 rotates, The rotation is transmitted to the one-way gear 108 through the rotational shaft 107 driven by the belt. The one-way gear 108 transmits the rotation to a worm gear 106. Tile worm gear 106 rotates the worm wheel 104 connected. There is provided a crank lever 103 connected free to turn through a rotational member which slidably rotates in contact with the inside of the peripheral wall surrounding the peripheral edge of a concave rotational board 105 provided above the worm gear 104. The other end of the crank lever 103 is connected free to turn to the staple unit 13.

When the worm wheel 104 rotates, the connected portion of the crank lever 103 moves in contact with the inside of the peripheral wall surrounding the peripheral edge of the rotational board 105 along with the rotation of the rotational board105. The rotational motion of the rotational board 105 is changed to linear motion by the crank lever 103. The crank lever 103 is to effect piston motion.

One end of the crank lever 103 and the connected portion of the worm wheel 104 in FIG. 5 are present externally of the staple unit 13, and the staple unit 13 is at a home position. In FIG. 4, as the worm wheel 104 rotates, the connected portion of the worm wheel 104 and the crank lever 103 is present internally of the staple unit 13. With this, the crank lever 103 is forced into the staple unit 13. The staple unit 13 connected to the crank lever 103 is pressed by the crank lever 103 and moves toward the matching member 101.

When movement of the staple unit 13 terminates, the inlet motor 110 stops. When the movement terminates, the conveyance in the shift operation mode (here, stapling) starts, and therefore, the inlet motor 110 begins its normal driving. The inlet roller 180 provided on the rotational shaft also rotates and drives. The arrival of the sheet at the receiving inlet 18 is detected by the inlet sensor 21 to begin the conveyance of the sheet S.

In this manner, the sheet post-treatment device of the present invention moves the staple unit 13 on the basis of an operating signal sent from the image forming apparatus G to vertically move the matching member 101. Sheets conveyed from the first conveying passage are placed on the treating tray 39, and the sheet end is pressed by the pressing means for matching.

After the prescribed number of sheets have been conveyed and matched, a bundle of sheets is stapled by the staple means, and the bundle of the sheets S within the treating tray unit is discharged to the accumulation tray 15 by the discharge roller 36 and the turning unit 24 which vertically turns about the shaft of the paddle driving roller.

The sheets S are switch-back conveyed along the second to third conveying routs 303, and a plurality of sheets are placed on the treating tray 39 and matched. After stapling has been carried out by the staple unit 13, the bundle of sheets S is discharged to the accumulation tray 15.

As shown in FIGS. 4 and 5, the staple unit 13 is provided with a pushing-up member 102 for vertically moving the matching member 101 as the matching reference means between the engaging position engaged with one end of the sheet to control it and the withdrawal position withdrawn from the engaging position. When a microprocessor 11A of the sheet discharge device 11 receives a request signal for operation of the staple unit 13, operation of movement of the staple unit 13 begins. When the staple unit 13 moves, the pushing-up member 102 provided on the staple unit 13 is released from the home position sensor 108 and moves together with the staple unit 13.

One end of the matching member 101 is connected free to turn to the treating tray 39 by a connecting member such as a screw and supported. The pushing-up member 102 is formed so that a prescribed angle is provided relative to a pushing and moving portion 120 for pushing up a contact portion 109 of the matching member 101, and the contact portion of the matching member 101 is pushed up as movement takes place. The matching member 101 is formed with a matching surface 112 and has a matching reference function similar to a fixed matching reference.

Further, when switching is made from a sheet S treating position of A5 size to a sheet S treatment of A3 size, a request signal for operation corresponding to a sheet S of large size such as A3 size is transferred from the image forming apparatus G to the sheet discharge device 11. When the sheet discharge device 11 receives a request signal for operation of the staple unit 13, operation of movement of the staple unit begins. When the staple unit 13 starts its movement, the pushing-up member 102 provided on the staple unit 13 moves together with the staple unit 13 and is joined to the home position sensor 108. At this time, the pushing and moving member 120 of the pushing-up member 102 moves away from the contact portion 109 of the matching member 101, and the matching member 101 turns and moves downward. The surface of the matching member 101 is the same level surface as the tray surface of the treating tray 39.

In this manner, the sheet S is matched with the matching reference adjusted to the size.

In the present invention, as described above, the treating tray 39 has a fixed matching reference and a matching reference of the vertically movable matching member 101. Since the matching reference and the position of the vertically movable matching member 101 are not slidably moved in the direction in which the sheet is matched, the matching reference position thereof is not deviated.

Further, it is desired that the paired rollers at two locations are arranged at equal intervals from the center of the sheet. When the pair of rollers 300 and 301 are at a position extremely different from the center of the sheet, the conveying direction of the sheet becomes unstable and the sheet moves obliquely to raise the dangerousness of jamming. In the image forming apparatus and the sheet discharge device according to the present application, the vertically movable matching member 101 is moved vertically adjusting to the sheets S of various sizes, and the matching position is changed to convey and discharge the sheets S. Because of this, even a sheet which is smaller in size than that in a prescribed lateral width direction is nipped about the arranging position of the paired rollers 300 an 302, and therefore, nipping by one pair of rollers on the reference side and the opposite side is not disengaged.

Therefore, it is not necessary to move the matching reference and the pressing means 205 adjusting to the size of the sheet S. It is not necessary to provide driving means for moving the position of the matching reference and the pressing means 205, thus simplifying the driving mechanism.

The pushing-up member 102 and the contact portion 109 need not be integral with the staple unit 13 and the matching member 101, respectively, but it may be designed so that the pushing-up member 102 is moved adjusting to the movement of the staple unit 13, and the matching member 101 comes in contact with the separate contact portion 109 to push up the matching member.

As described above, the sheet discharge device of the present invention is able to move the staple unit 13 on the basis of the operating signal sent from the image forming apparatus corresponding to the sheet S to be treated, and vertically move the matching member 101 to carry out matching with the tray width adjusting to the sheet.

The sheet conveyed from the second conveying route 302 is placed on the treating tray 39, and the end of the sheet is pressed by the pressing means 205 and matched.

The matching is carried out in the following procedure. When a sheet is conveyed to the treating tray 39, a matching motor (not shown) drives in normal rotation, rotation of which is transmitted to the pressing means 205 through the matching belt 113, and the pressing means 205 moves to press the end of the sheet to match it. When the first matching is completed, a matching motor (not shown) reversally drives to move the pressing means 205 away from the sheet end. For the second matching, similarly, a matching motor (not shown) drives in normal rotation, rotation of which is transmitted to the pressing means 205 through the matching belt 113, and the pressing means 205 moves to press the end of the sheet to match it.

When the matching is completed, a matching motor (not shown) reversely drives to move the pressing means 205 away from the sheet end. A matching motor (not shown) stops, and awaits the conveyance of a next sheet to the treating tray 39.

When the prescribed number of sheets are conveyed and matching is completed, the sheet bundle is stapled by the staple means, and the bundle of sheets S within the treating tray 30 is discharged to the accumulation tray 15 by the discharge roller 36 and the turning unit 24 which turns vertically about the shaft of the paddle driving roller.

Figure 7:
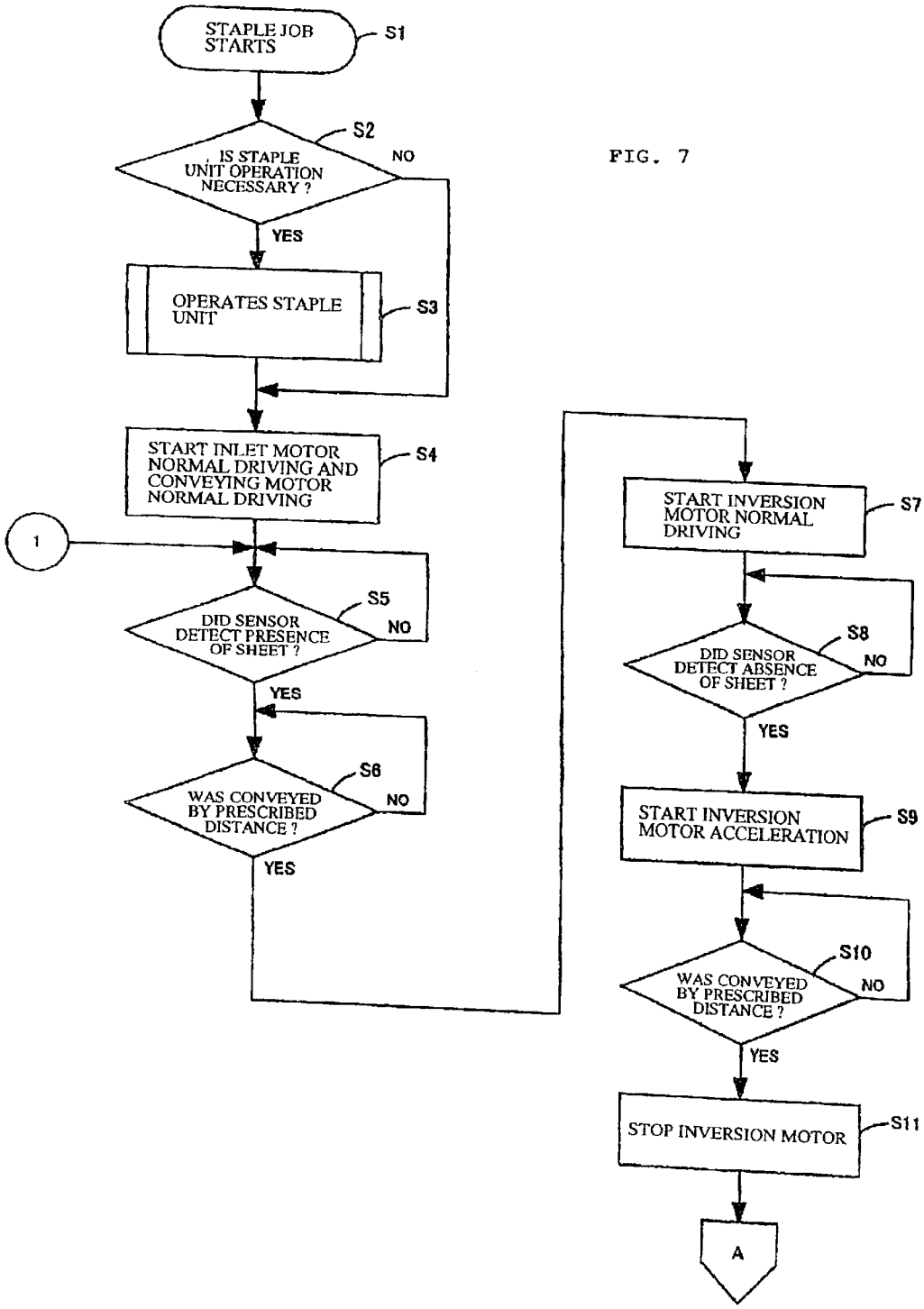
FIG. 7 is a block diagram (first) for explaining operation control of a shift operation mode (stapling) in the present sheet discharge device.
Figure 8:
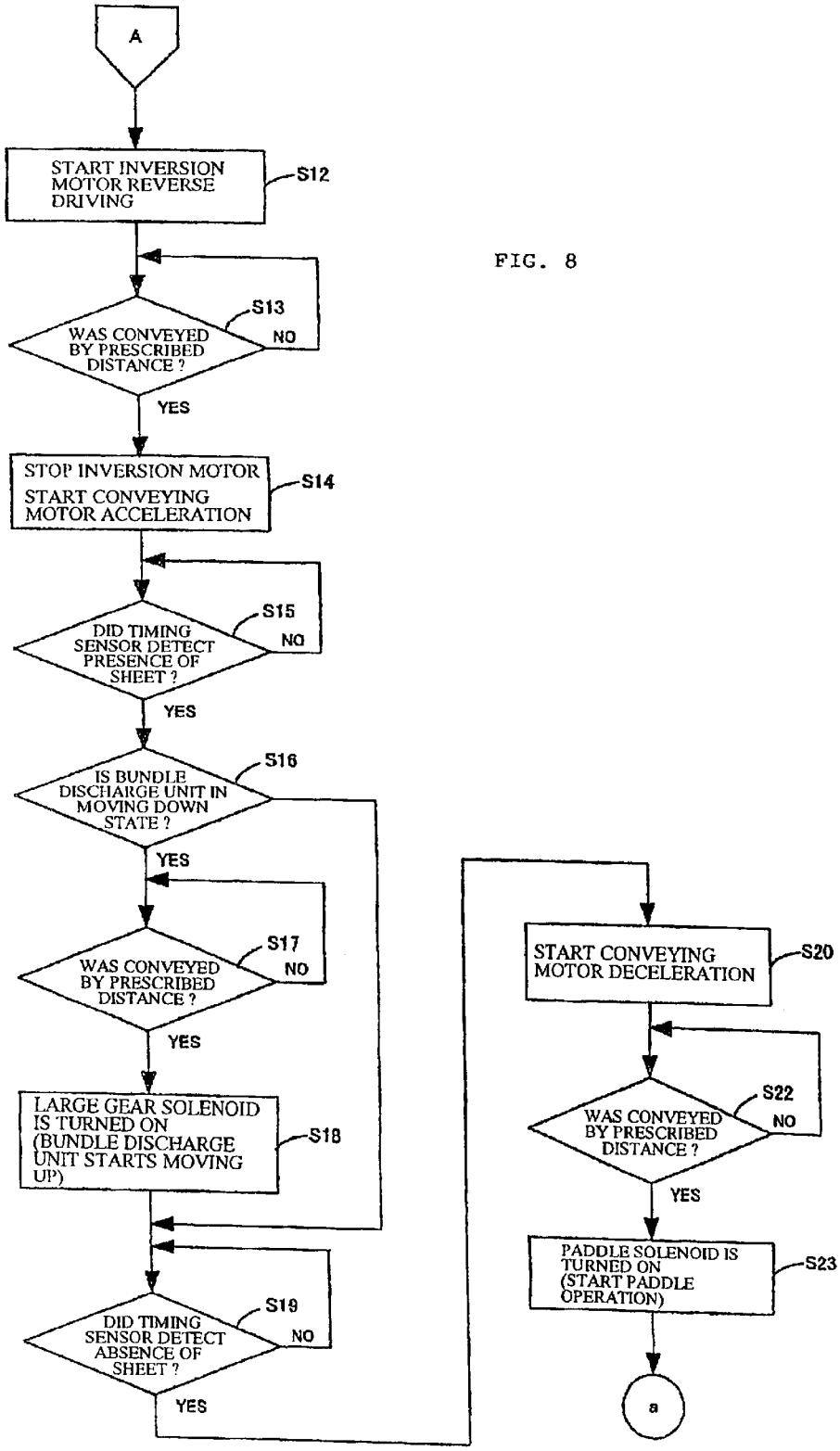
FIG. 8 is a block diagram (second) for explaining operation control of a shift operation mode (stapling) in the present sheet discharge device.
Figure 9:
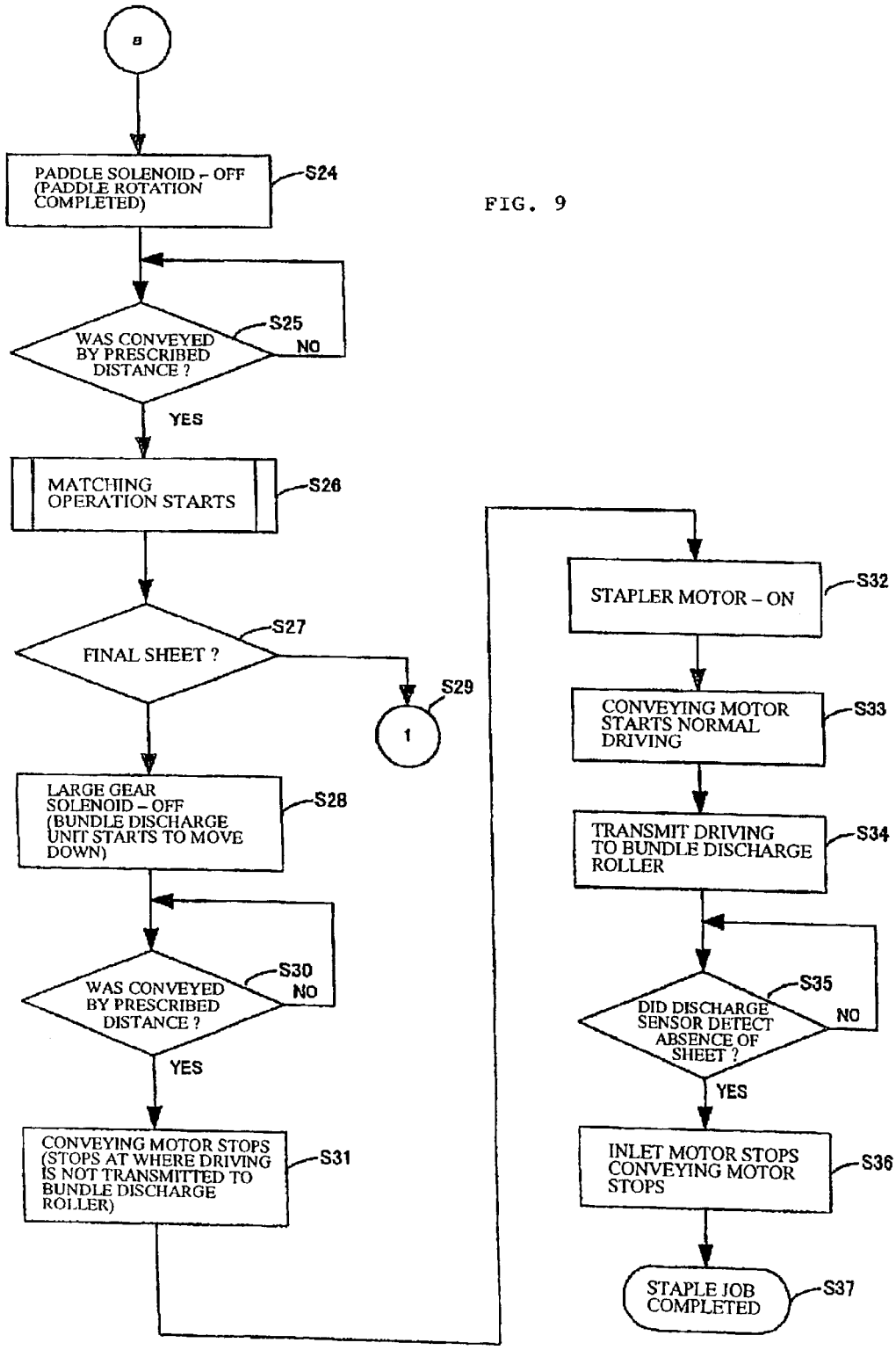
FIG. 9 is a block diagram (third) for explaining operation control of a shift operation mode (stapling) in the present sheet discharge device.

Next, operation of the embodiments corresponding to the present invention will be described on the basis of flowcharts shown in FIGS. 7, 8 and 9.

When the staple treatment starts (S1), first, necessity of movement of the staple unit 13 is judged from information of the sheet S size (S2). If the movement is necessary, moving operation of the staple unit 13 is carried out (S3). The movement of the staple unit 13 is carried out when the sheet S size is changed. For example, when the sheet size is changed from A3 to A4 SEF, the movement of the staple unit 13 is carried out. Further, when the sheet size is changed from A4 SEF to A3, the movement of the staple unit 13 is likewise carried out also.

The moving conditions of the staple unit 13 are set according to the sizes of the sheets S.

At the time of the A group of large size, the staple unit 13 is at a home position, and the matching member 101 is not pushed up.

At the time of the B group of small size, the staple unit 13 is forced into the body device 12, and the matching member 101 is pushed up.

Next, the inlet motor 110 and the conveying motor 160 begin to drive.

First, the inlet sensor 21 detects the presence of a sheet S (S5). When a sheet is present, the sheet is conveyed to the first conveying route 300 by the inlet roller 180. When conveyance of a sheet S for a prescribed distance is detected, the inversion motor 161 starts to drive in normal mode (S6, S7). When the fact that a rear end of a sheet moves away from the inlet sensor is detected, the inversion motor 161 accelerates its rotation (S8, S9). A sheet S is conveyed to the switch-back route 301 by the switch-back roller 181 and is guided to the inversion tray 50. When the sheet S is conveyed by a prescribed distance (S10), the inversion motor 161 stops (S11). Next, the inversion motor 161 starts its inverted driving (S12).

The sheet S is inverted in its upper surface at the time when being taken in from the inlet, and is conveyed from the inversion tray 50 to the second conveying route 302. When conveyance by a prescribed distance is detected (S22), a paddle solenoid is turned on, and the turning unit 24 is turned to an upper position to guide a sheet S (S23, S24). The sheets S are accumulated on the treating tray 39.

When the conveyance of the sheet S by a prescribed distance is detect, (S25), matching of the accumulated sheets S is carried out (S26). Matching of the sheet S housed is carried out (S26). In matching a sheet S, the sheet S is pressed by the pressing means 205 on the reference side of the treating tray 39 to carry out matching. Where the sheet S is not a final sheet, similar operation is repeated from S5 step till the final sheet S is detected (S29).

In case of the final sheet S, the turning unit 24 starts to move down (S28). When being conveyed by a prescribed distance, the conveying motor steps (S31). Here, a stapler motor (not shown) is turned on, and stapling is carried out (S32). Here, the conveying motor 160 starts its driving in normal mode (S33). The driving is transmitted to the discharge roller 25 of the turning unit 24 positioned downward previously (S34). A bundle of sheets S subjected to stapling is discharged onto the treating tray 15. When discharging of the bundle of sheets S is terminated, the inlet motor 110 and the conveying motor 160 stop to terminate the staple treatment (S36, S37).

As explained in detail in the foregoing, in the present sheet discharge device according to the present invention, for example, a plurality of reference members different in a reference position for arranging one end of a sheet on housing means is provided, the plurality of reference members except at least the reference member at a reference position farthest from matching means out of them is movable between an engaging position in engagement with one end of the sheet on the housing means and a withdrawal position withdrawn from the engaging position, and common moving means for actuating moving means for selectively moving the reference members except the reference members used is provided whereby the reference position is changed according to a discharge reference when the sheet is discharged and the sheet size.

Thereby, it is possible to replace sheets of a wide range of sizes, and a matching reference is formed at a plurality of fixed positions. Further, staple means for stapling ends of the matched sheets can be moved from the home position toward the matching member according to the sheet size matched and a discharge reference of a sheet.

Thereby, the present invention realizes the sheet discharge device for enabling the stabilization for a long period of the matching performance by a simpler mechanism.

Further, in the sheet post-treatment device according to the present invention, a part of the treating tray is notched by a moving portion in order to secure a moving space of moving staple means to form a notch, and a slide tray for complementing the notch is formed integral with the staple unit 13 so as to be moved simultaneously.

By the provision of such a constitution as described, in the present invention, dropping of a sheet into the notch is prevented to prevent matching quality of a sheet from lowering, exclusive-use driving means with respect to vertical movement of the matching member and movement of the slide tray is not required, and simplification of a driving mechanism, labor saving and miniaturization of a device size are realized.

We claim:

1. A sheet discharge device, comprising:

housing means for housing a sheet discharged from an image forming apparatus;

matching reference means comprising a plurality of reference members different in matching reference positions for arranging one end of the sheet on said housing means to one predetermined reference member in said reference members;

matching means for moving the sheet to said matching reference means to arrange the one end of the sheet;

post-treatment means moving to a post-treatment position corresponding to a matching reference position for said matching reference means to apply a prescribed post-treatment to the sheet; and a moving route for said post-treatment means to move to said post-treatment position, said moving route being formed from a notch portion provided in a sheet place portion of said housing means.

2. The sheet discharge device according to claim 1, further comprising support means for supporting the sheet within said moving route.

3. The sheet discharge device according to claim 2, wherein said support means comprises a lower support portion which moves following said post-treatment means to move into a portion below a sheet place portion of the housing means, an upper support portion for supporting the sheet at substantially a same height as said sheet place portion, and an inclined support portion for connecting said lower support portion and said upper support portion.

4. The sheet discharge device according to claim 2, wherein said support means is secured to said post-treatment means.

5. The sheet discharge device according to claim 2, wherein said support means has a control member for arranging an end of the sheet adjacent to the one end of the sheet arranged by said matching reference means.

6. The sheet discharge device according to claim 2, wherein said support means has weight means for preventing a curl of the sheet.

7. The sheet discharge device according to claim 1, further comprising:

support means for movably supporting said plurality of reference members except at least a reference member at a reference position farthest from said matching means between an engaging position engaged with the one end of the sheet on said housing means and a withdrawal position withdrawn from said engaging position; and moving means for selectively moving said reference member support means so as to differentiate said reference position according to a discharge reference when the sheet is discharged and a sheet size.

8. The sheet discharge device according to claim 7, further comprising common driving means for moving said post-treatment means to actuate said moving means.

9. The sheet discharge device according to claim 8, wherein said moving means is formed from a friction member which moves with said post-treatment means, and a contact member which engages said friction member according to movement of said post-treatment means to move said reference member to said engaging position, and disengages from said friction member to move said reference member to the withdrawal position.

10. A sheet discharge device, comprising:

housing means for housing a sheet discharged from an image forming apparatus;

matching reference means comprising a plurality of reference members different in matching reference positions for arranging one end of the sheet on said housing means to one predetermined reference member in said reference members;

matching means for moving the sheet to said matching reference means to arrange the one end of the sheet;

post-treatment means moving to a post-treatment position corresponding to a matching reference position for said matching reference means to apply a prescribed post-treatment to the sheet;

a moving route for said post-treatment means to move to said post-treatment position; and support means for supporting the sheet within said moving route, said support means being changed in a region for supporting the sheet according to the matching reference position of said matching reference means.

11. A sheet discharge device, comprising:

conveying means for receiving a sheet discharged from an image forming apparatus to convey the sheet to housing means; and common driving means for driving said conveying means to convey the sheet, and moving post-treatment means to a post-treatment position.

12. The sheet discharge device according to claim 11, wherein said driving means drives said conveying means with one of normal and reverse driving forces to convey the sheet, and drives said post-treatment means with the other of the normal and reverse driving forces to move the same.

13. An image forming apparatus, comprising:

an image forming portion for forming an image on a sheet;

housing means for housing the sheet discharged from said image forming portion;

matching reference means comprising a plurality of reference members different in reference position for arranging one end of the sheet on said housing means;

matching means for moving the sheet to said matching reference means to arrange the one end of the sheet;

transmission means for transmitting a signal representative of at least a sheet size of the sheet or a discharge reference at which the sheet is discharged;

reference member support means for movably supporting the plurality of the reference members except a reference member at a reference position farthest from said matching means between an engaging position engaging the one end of the sheet on said housing means and a withdrawal position withdrawn from said engaging position;

moving means for moving the reference member supported by said reference member support means between said engaging position and said withdrawal position; and control means for controlling said moving means so that said reference member is selectively moved to said withdrawal position according to the signal from said transmission means to differentiate said reference position.

14. The image forming apparatus according to claim 13, further comprising post-treatment means which moves to a post-treatment position corresponding to said reference position to apply a prescribed post-treatment to the sheet.

15. A sheet discharge device, comprising:

housing means for housing a sheet discharged from an image forming apparatus;

matching reference means to be a reference for arranging the sheet on said housing means;

matching reference position changing means for moving said matching reference means to change a matching reference position for arranging the sheet;

matching means for moving the sheet to said matching reference means to arrange the sheet;

post-treatment means which moves to a post-treatment position corresponding to the matching reference position of said matching reference means to apply a prescribed post-treatment to the sheet;

a moving route for said post-treatment means to move to said post-treatment position;

support means for supporting the sheet within said moving route; and common driving means for actuating said post-treatment means and said matching reference means.

16. A sheet discharge device comprising:

housing means for housing a sheet discharged from an image forming apparatus;

matching reference means to be a reference for arranging the sheet on said housing means;

matching reference position changing means for moving said matching reference means to change a matching reference position for arranging the sheet;

matching means for moving the sheet to said matching reference means to arrange the sheet;

post-treatment means which moves to a post-treatment position corresponding to the matching reference position of said matching reference means to apply a prescribed post-treatment to the sheet;

a moving route for said post-treatment means to move to said post-treatment position;

support means for supporting the sheet within said moving route;

conveying means for receiving the sheet discharged from the image forming apparatus to convey the sheet to said housing means; and common driving means for driving said conveying means to convey the sheet, and moving said post-treatment means to said post-treatment position.

17. The sheet discharge device according to claim 16, wherein said driving means drives said conveying means with one of normal and reverse driving forces to convey the sheet, and drives said post-treatment means with the other of the normal and reverse driving forces to move the same.

* * * * *